US011435060B1

(12) United States Patent
Zhang

(10) Patent No.: US 11,435,060 B1
(45) Date of Patent: Sep. 6, 2022

(54) POLYGONAL ROTARY PROJECTION LAMP

(71) Applicant: GEMMY INDUSTRIES CORPORATION, Coppell, TX (US)

(72) Inventor: Cheng-Chun Zhang, Shenzhen (CN)

(73) Assignee: GEMMY INDUSTRIES CORPORATION, Coppell, TX (US)

( * ) Notice: Subject to any disclaimer, the term of this patent is extended or adjusted under 35 U.S.C. 154(b) by 0 days.

(21) Appl. No.: 17/709,309

(22) Filed: Mar. 30, 2022

(51) Int. Cl.

| | |
|---|---|
| ***F21V 1/00*** | (2006.01) |
| ***F21V 17/02*** | (2006.01) |
| ***F21S 9/02*** | (2006.01) |
| ***F21V 3/02*** | (2006.01) |
| *F21V 1/10* | (2006.01) |

(52) U.S. Cl.
CPC ..... *F21V 17/02* (2013.01); *F21S 9/02* (2013.01); *F21V 3/02* (2013.01); *F21V 1/10* (2013.01)

(58) Field of Classification Search
CPC . F21V 14/06; F21V 14/08; F21V 1/06; F21V 1/08; F21V 1/10; F21V 17/02; F21V 3/02; Y10S 362/806; F21S 9/02
See application file for complete search history.

(56) References Cited

U.S. PATENT DOCUMENTS

| | | | | |
|---|---|---|---|---|
| 932,772 A * | 8/1909 | Fleck | F21V 1/06 | 362/162 |
| 4,124,881 A * | 11/1978 | Haber | A63F 9/0415 | 362/806 |
| 4,992,917 A * | 2/1991 | Earnshaw | F21V 7/05 | 362/352 |
| 5,605,396 A * | 2/1997 | Chin, Jr | F21V 1/06 | 362/360 |
| 7,473,002 B1 * | 1/2009 | Chen | F21V 33/0028 | 362/35 |

* cited by examiner

*Primary Examiner* — Y M. Quach Lee
(74) *Attorney, Agent, or Firm* — Hershkovitz & Associates, PLLC; Abe Hershkovitz

(57) ABSTRACT

A polygonal rotary projection lamp has a base, a polygonal frame, a film set, a polygonal fixing frame, and an illumination set. The base has a disc configured to be driven to spin. The polygonal frame is mounted to the disc and has multiple bottom frame units. The film set is mounted to the polygonal frame and has multiple film units mounted to the polygonal frame and covering the multiple bottom frame units respectively. Each film unit is flat and has a pattern. The polygonal fixing frame is detachably mounted to the polygonal frame and has multiple top frame units respectively connected to the multiple bottom frame units to respectively fix the multiple film units. The illumination set is mounted within the base and emits light toward the polygonal frame. The light passes through each film unit with the pattern to project the pattern.

20 Claims, 10 Drawing Sheets

POLYGONAL ROTARY PROJECTION LAMP

BACKGROUND OF THE INVENTION

1. Field of the Invention

The present invention relates to a projection lamp, and more particularly to a polygonal rotary projection lamp that solves a problem that patterns of a conventional polygonal projection lamp are irreplaceable and increase time and expense for printing.

2. Description of Related Art

In order to improve the lifestyle, people use a decoration lamp in their daily life. The decoration lamp has a lampshade and an illuminating unit. The lampshade is transparent and three-dimensional and covers the illuminating unit. The illuminating unit may emit light toward the lampshade. The light emitted by the illuminating unit passes through the lampshade to create a light effect for decoration.

Furthermore, a lampshade with a polygonal shape and a pattern printed thereon is produced. The lampshade is connected to a rotatable platform to form a rotary decoration lamp. The rotatable platform drives the lampshade to spin. When the light, emitted by the illuminating unit, passes through the spinning lampshade, with the pattern on the lampshade, a variety of light effects are created and decorative effect of the decoration lamp is promoted.

Nowadays, in order to produce a lampshade which is polygonal and transparent and has a pattern, two three-dimensional shells have to be made of transparent materials in advance. Each shell has to be printed with a pattern. Then, the two shells are adhered via glue. However, a surface of each shell being polygonal is composed of multiple faces arranged at various angles. When printing a pattern on each shell, the multiple faces of each shell have to be printed one by one. Each shell has to be constantly rotated for printing said pattern on each of the multiple faces of the shell, increasing time consumption. Moreover, the pattern of each shell is directly printed on the shell and cannot be replaced, such that the decorative effect of the decoration lamp is limited.

To overcome the shortcomings of the aforementioned decoration lamp, the present invention provides a polygonal rotary projection lamp to mitigate or obviate the aforementioned problems.

SUMMARY OF THE INVENTION

The main objective of the present invention is to provide a polygonal rotary projection lamp which can reduce cost of production.

A polygonal rotary projection lamp has a base, a polygonal frame, a film set, a polygonal fixing frame, and an illumination set. The base has a disc configured to be driven to spin. The polygonal frame is mounted to the disc and has multiple bottom frame units. The film set is mounted to the polygonal frame and has multiple film units mounted to the polygonal frame and covering the multiple bottom frame units respectively. Each film unit is flat and has a pattern. The polygonal fixing frame is detachably mounted to the polygonal frame and has multiple top frame units respectively connected to the multiple bottom frame units to respectively fix the multiple film units. The illumination set is mounted within the base and emits light toward the polygonal frame. The light passes through each film unit with the pattern to project the pattern.

Benefits of the present invention are:

In the process of manufacturing the polygonal rotary projection lamp of the present invention, the polygonal frame, the film set, and the polygonal fixing frame are manufactured individually. The film units of the film set are respectively covered on the bottom frame units of the polygonal frame. The top frame units of the polygonal fixing frame are respectively assembled to the bottom frame units to fix the multiple film units to the polygonal frame. Then, the polygonal frame is assembled to the disc of the base, and assembly of the polygonal rotary projection lamp of the present invention is finished. Each film unit of the film set is flat, is convenient for printing patterns, and can save time for printing and reduce production cost. Since the film set can be printed in advance and can be connected to the polygonal frame by simple assembly, production time of the polygonal rotary projection lamp of the present invention is shortened accordingly. In addition, the film set can be detached from the polygonal frame and replaced by another film set with different patterns. Decorative effect of the polygonal rotary projection lamp of the present invention is promoted.

Other objects, advantages, and novel features of the invention will become more apparent from the following detailed description when taken in conjunction with the accompanying drawings.

DETAILED DESCRIPTION OF PREFERRED EMBODIMENTS

Figure 1:
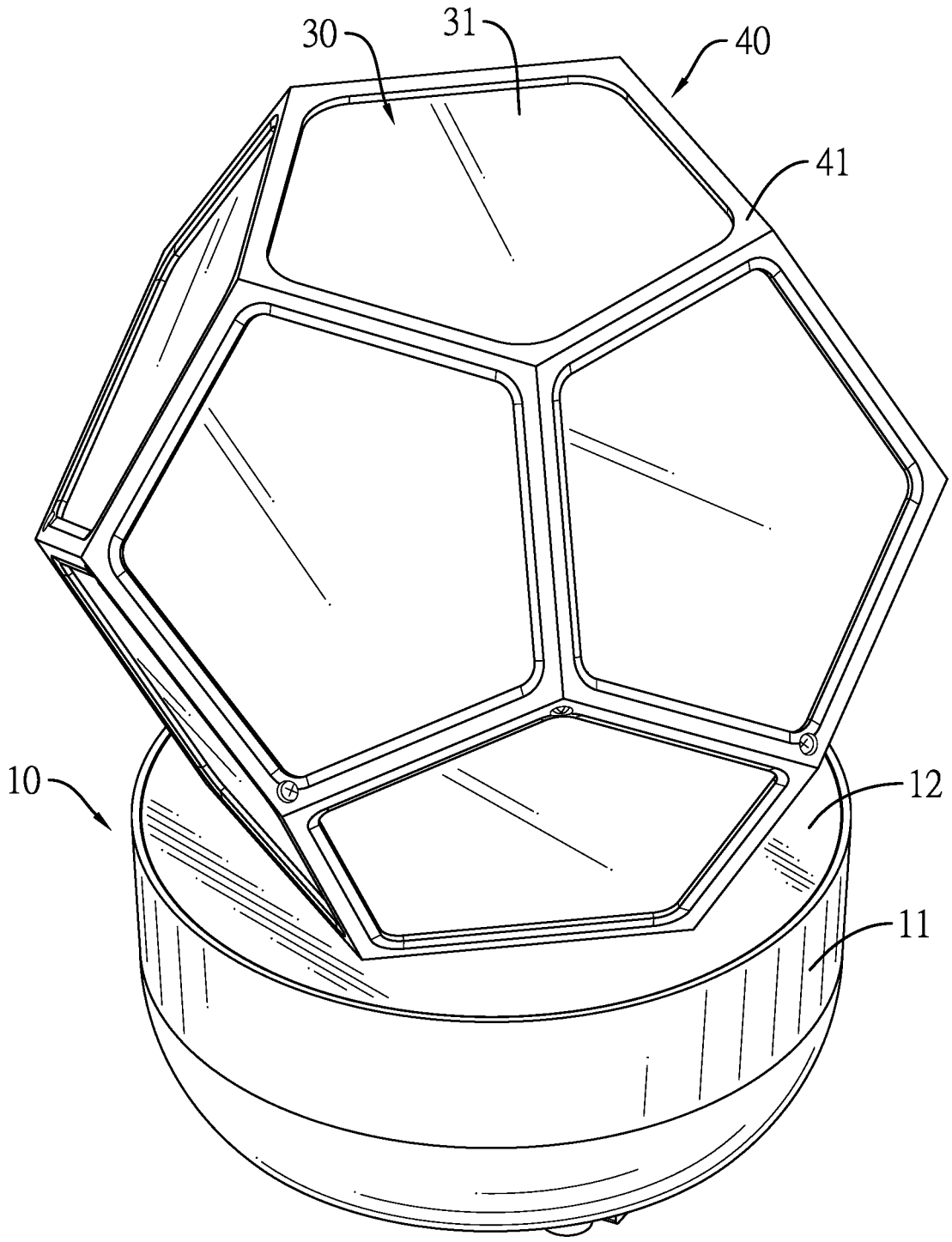
FIG. 1 is a perspective view of a polygonal rotary projection lamp in accordance with the present invention.
Figure 2:
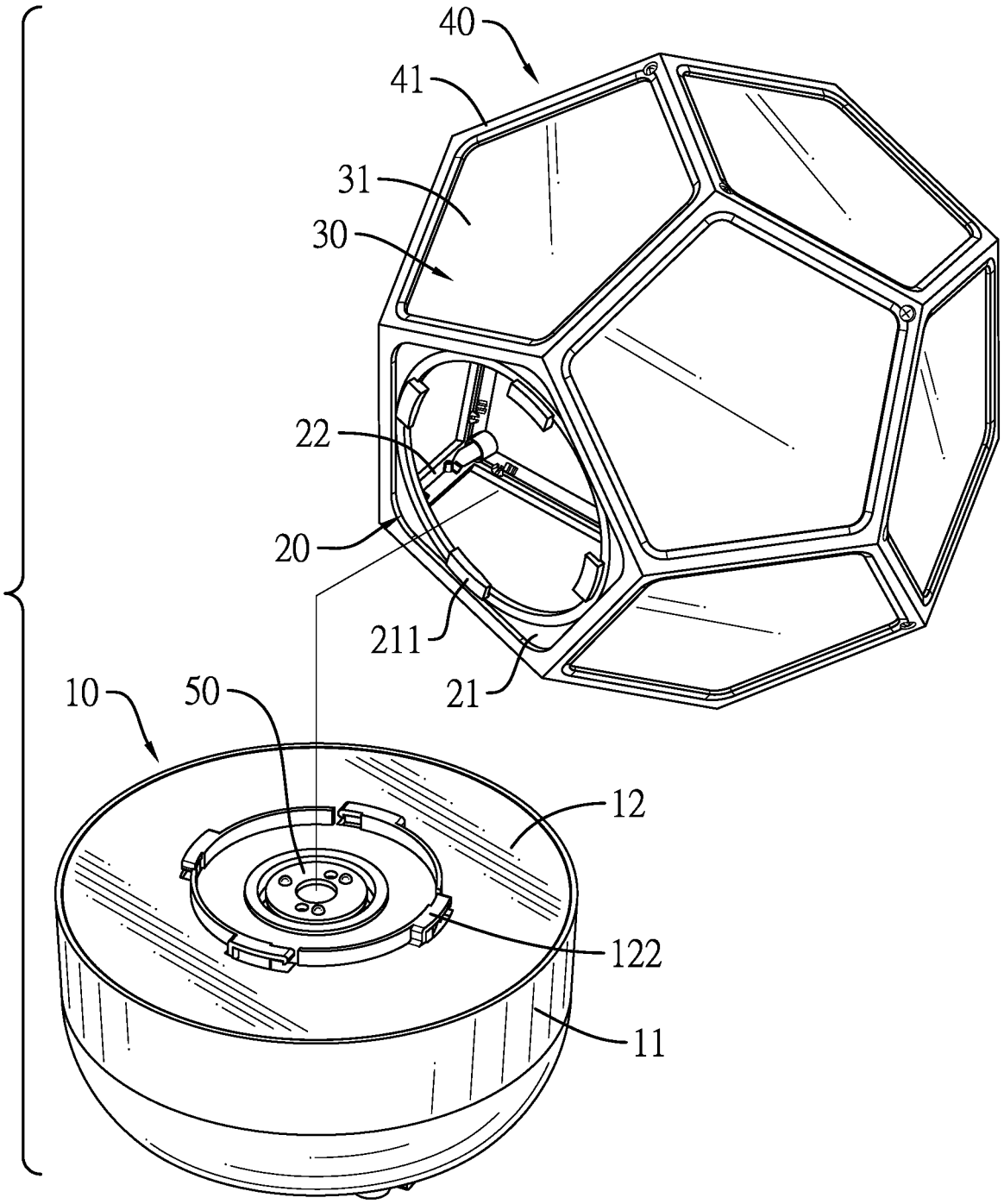
FIG. 2 is a partially exploded perspective view of the polygonal rotary projection lamp in FIG. 1.

With reference to FIGS. 1 and 2, a polygonal rotary projection lamp in accordance with the present invention has a base 10, a polygonal frame 20, a film set 30, a polygonal fixing frame 40, and an illumination set 50.

Figure 3:
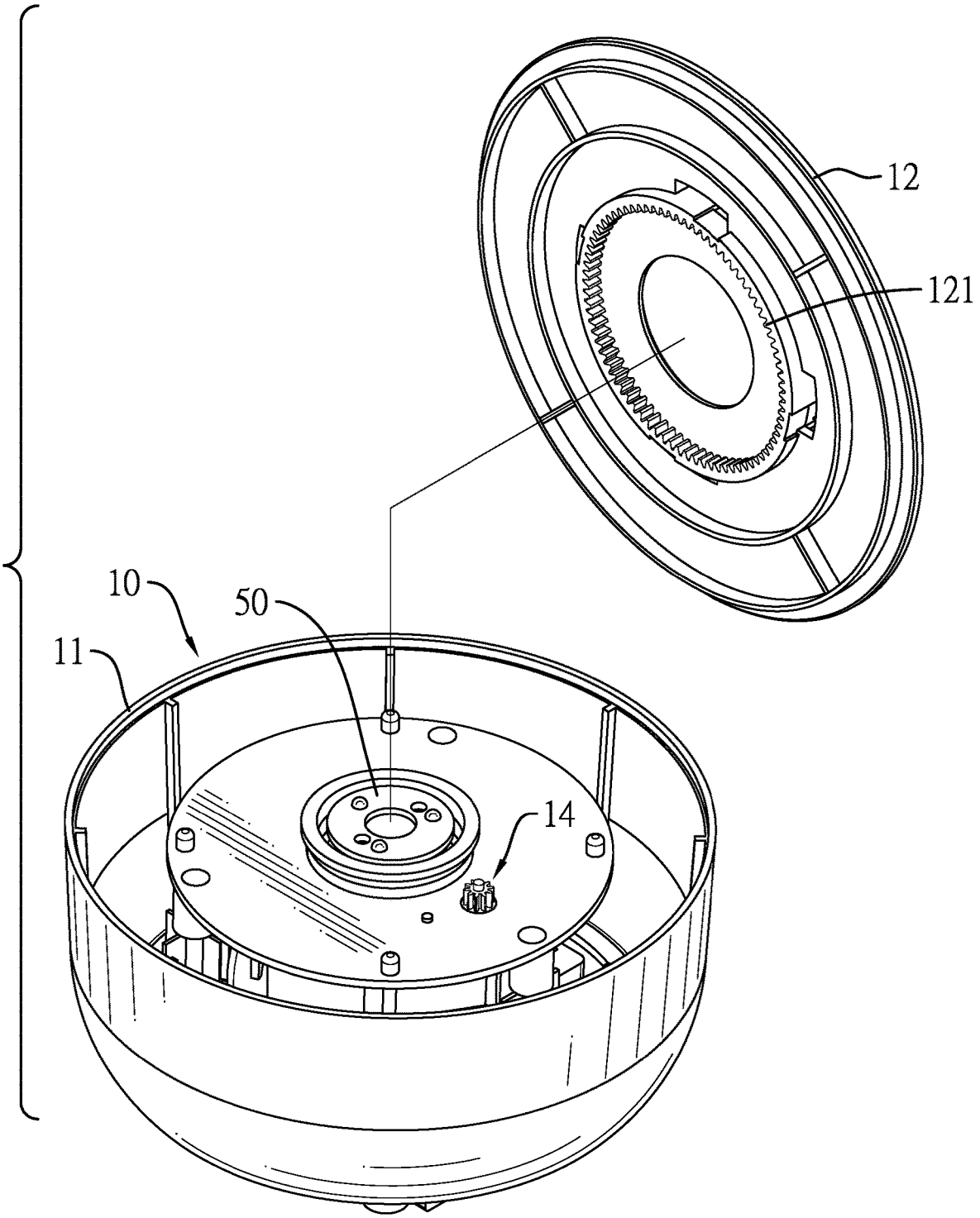
FIG. 3 is an exploded perspective view of a base of the polygonal rotary projection lamp in FIG. 1.
Figure 4:
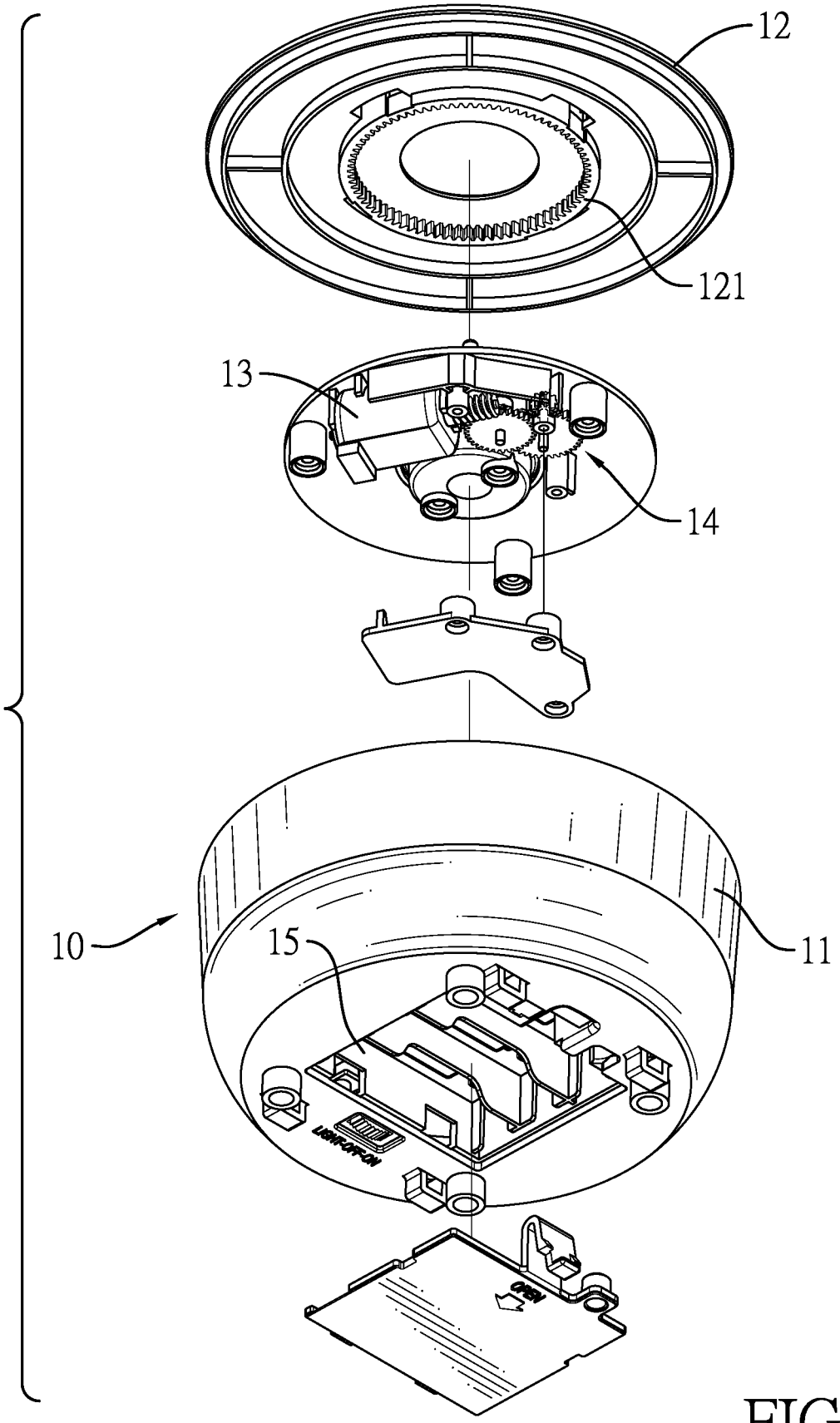
FIG. 4 is another exploded perspective view of the base in FIG. 3.

With reference to FIGS. 2 to 4, the base 10 has a basal body 11 and a disc 12. The disc 12 is mounted to the basal body 11 and configured to be driven to spin. Wherein, the disc 12 has a ring gear 121 disposed on a bottom of the disc 12. The basal body 11 of the base 10 has a driving motor 13 and a driving gear set 14 disposed therein. The driving motor 13 is connected to the driving gear set 14. The driving gear set 14 is connected to the ring gear 121. The driving motor 13 is configured to be electrically connected to a power supply and drives the disc 12 to spin via the driving gear set 14 and the ring gear 121 of the disc 12.

Figure 6:
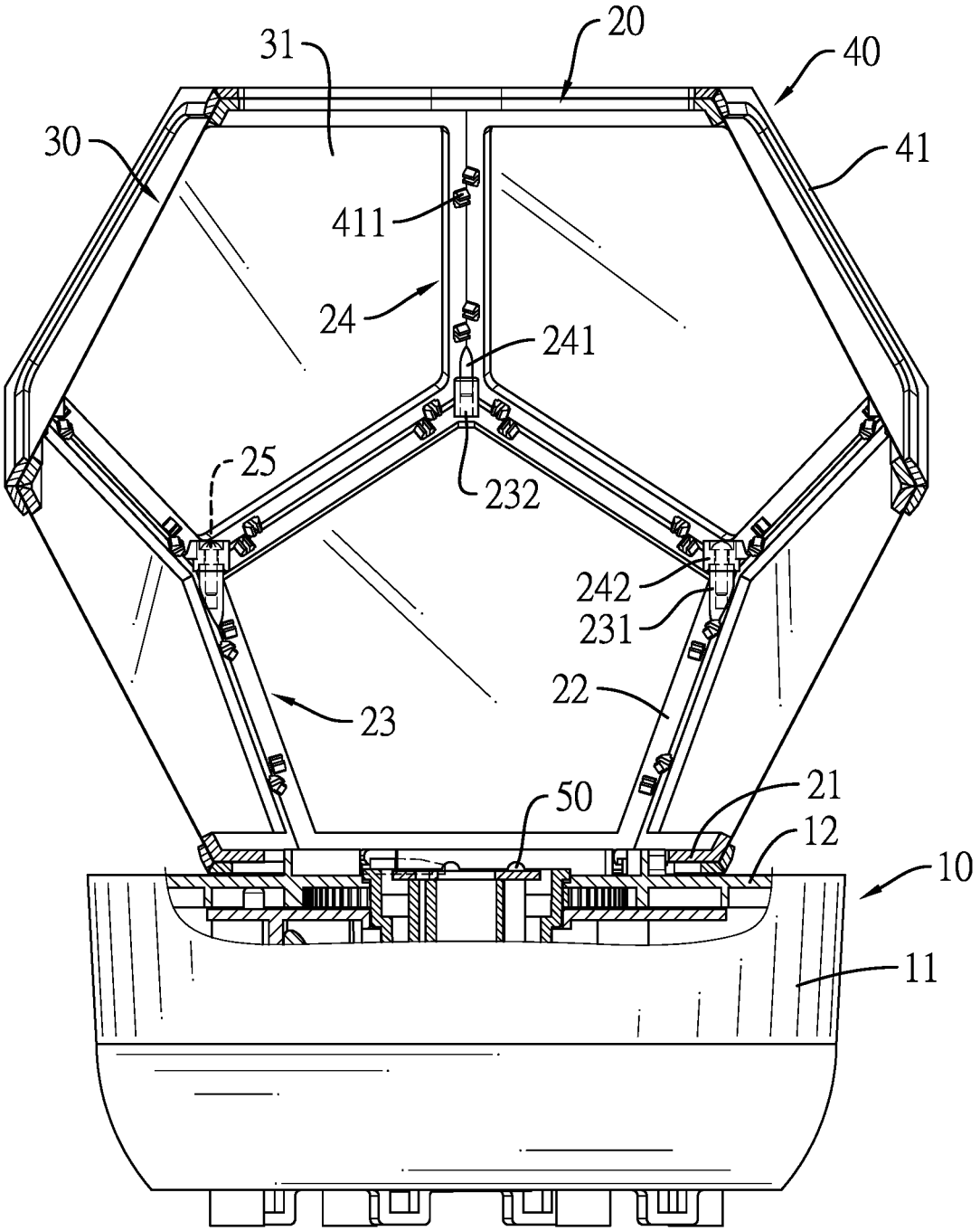
FIG. 6 is a cross-sectional side view along cutting plane 6-6 in FIG. 5.

With reference to FIGS. 1, 2, and 6, the polygonal frame 20 is mounted to the disc 12 of the base 10 and can spin together with the disc 12. The polygonal frame 20 has a basal frame unit 21 and multiple bottom frame units 22. The multiple bottom frame units 22 are connected to one another and are disposed at the basal frame unit 22. Wherein, the basal frame unit 21 and the multiple bottom frame units 22 respectively have an empty central portion or are made of transparent or translucent materials to be passed through by light.

Figure 8:
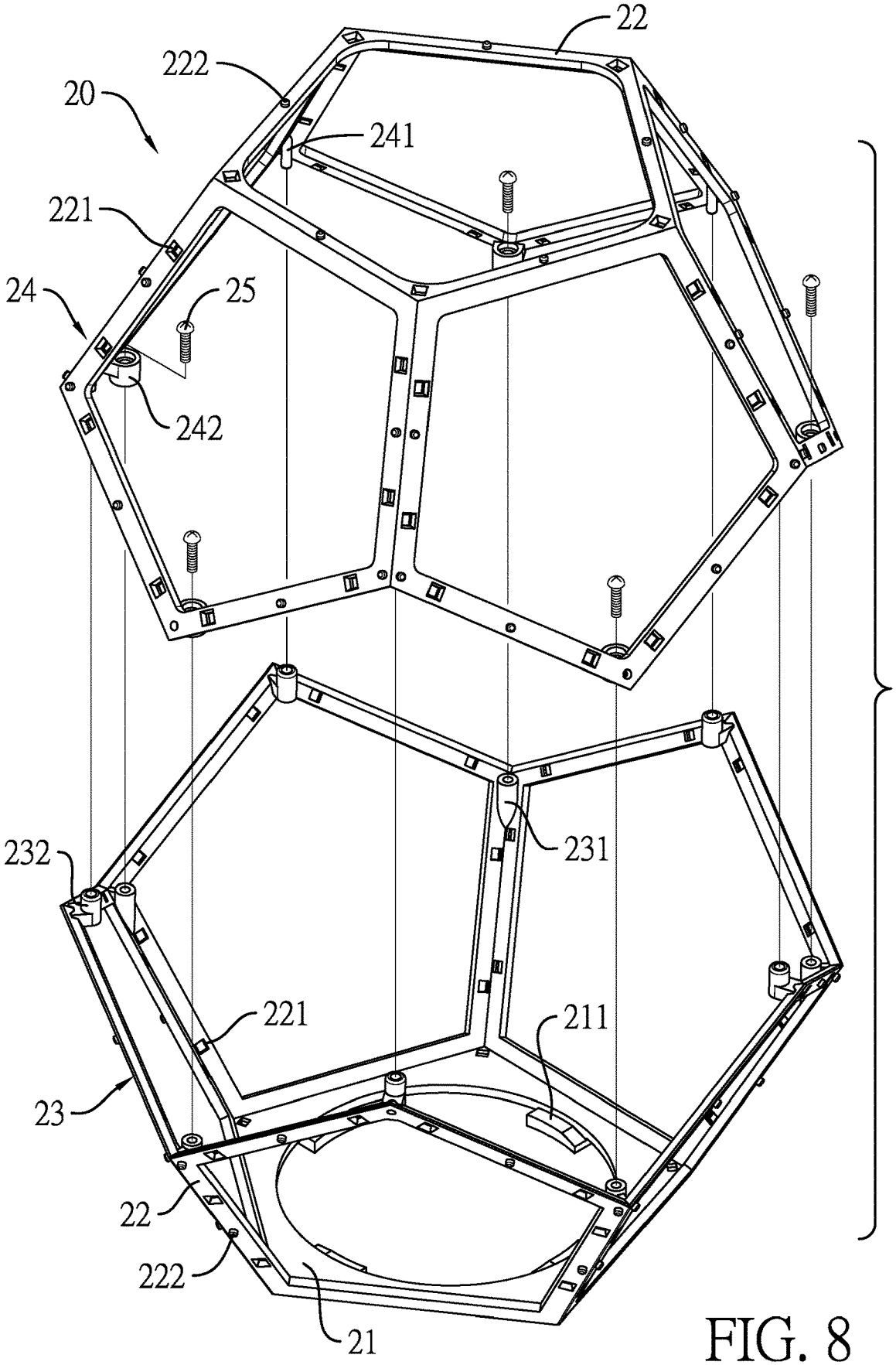
FIG. 8 is an exploded perspective view of a polygonal frame of the polygonal rotary projection lamp in FIG. 1.

The polygonal frame 20 can be an integrally formed component being homogeneous to promote convenience of assembly of the polygonal frame 20. With reference to FIGS. 6 and 8, in an embodiment of the present invention, the polygonal frame 20 has a first framework 23 and a second framework 24 detachably connected. The first framework 23 has the basal frame unit 21 and a part of the multiple bottom frame units 22. The basal frame unit 21 is assembled to the disc 12 of the base 10. The second framework 24 has the other part of the multiple bottom frame units 22. The first framework 23 has multiple first positioning portions 231 and multiple first aligning units 232. The second framework 24 has multiple second positioning portions 241 and multiple second aligning units 242. The multiple first positioning portions 231 of the first framework 23 are configured to be respectively assembled to the multiple second aligning units 242 of the second framework 24. The multiple second positioning portions 241 are configured to be respectively assembled to the multiple first aligning units 232 of the first framework 23. The polygonal frame 20 composed of the first framework 23 and the second framework 24 assembled together reduces production cost of the polygonal frame 20.

Furthermore, the polygonal frame 20 has multiple bolts 25. The multiple bolts 25 are configured to be respectively screwed to the multiple first positioning portions 231 of the first framework 23 and the multiple second aligning units 242 of the second framework 24 to promote stability of assembly between the first framework 23 and the second framework 24.

Otherwise, with reference to FIG. 2, the disc 12 has multiple clasps 122 arranged circularly. The basal frame unit 21 has multiple engaging portions 211 arranged circularly. Each clasp 122 and each engaging portion 211 correspond in structure. The basal frame unit 21 of the first framework 23 is detachably connected to the disc 12 via engagements of the multiple engaging portions 211 and the multiple clasps 122 of the disc 12.

Figure 5:
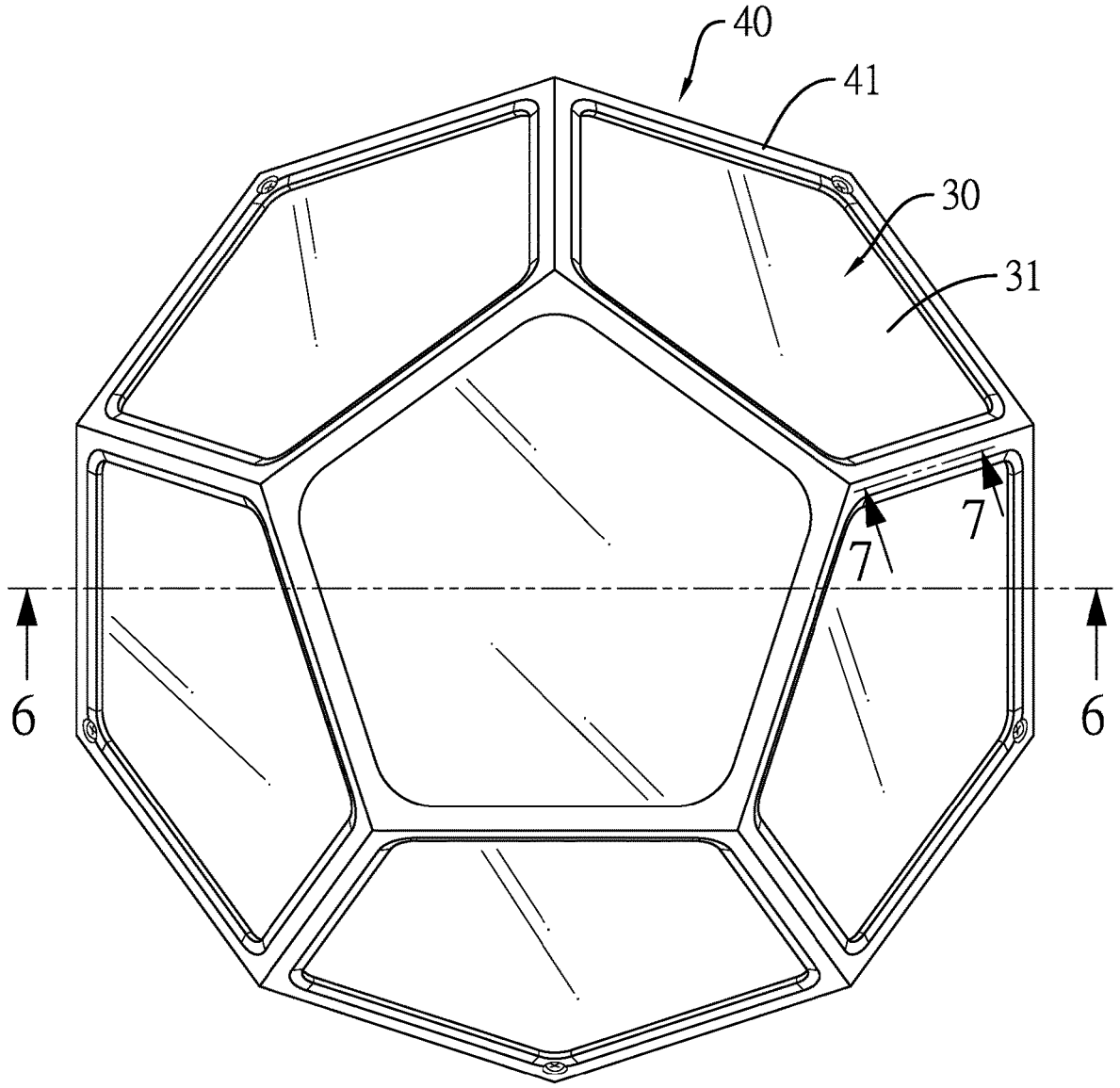
FIG. 5 is a top view of the polygonal rotary projection lamp in FIG. 1.
Figure 7:
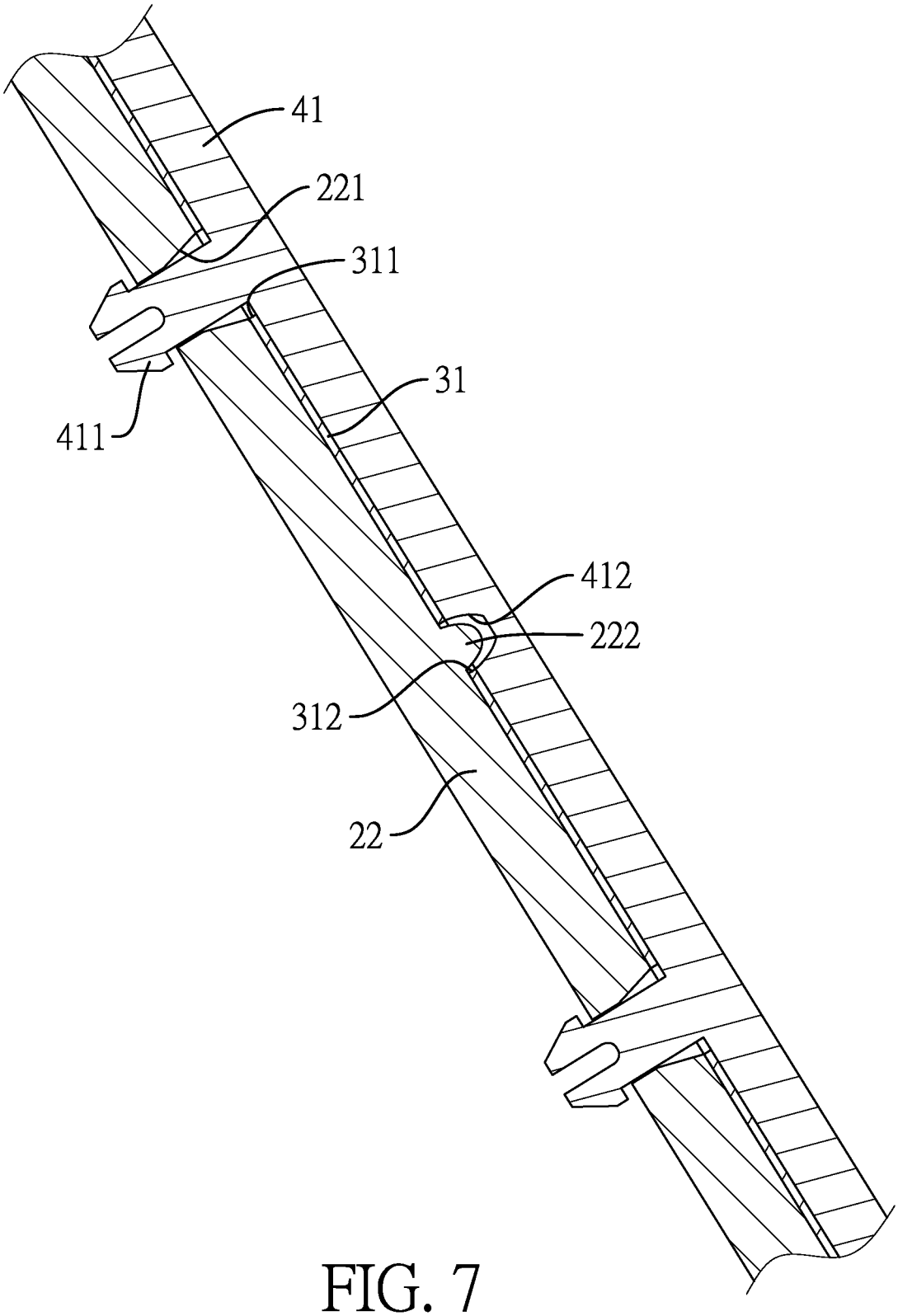
FIG. 7 is an enlarged cross-sectional side view along cutting plane 7-7 in FIG. 5.

With reference to FIGS. 5 to 7, the film set 30 is assembled to the polygonal frame 20 and has multiple film units 31. Each film unit 31 is flat and has a pattern. The multiple film units 31 are respectively covered to the bottom frame units 22 of the polygonal frame 20. Each film unit 31 is flat and is convenient for printing the pattern and can save time for printing.

Preferably, each of the multiple film units 31 of the film set 30 can be an individual unit to reduce remainder from producing the film set 30 and to make each film unit 31 replaceable to increase variations of light effect of the polygonal rotary projection lamp. Alternatively, the film set 30 has two films 30*a*. A part of the multiple film units 31 form one of the two films 30*a* and correspond in size and shape to and are mounted to the first framework 23. The other part of the multiple film units 31 form the other one of the two films 30*a* and correspond in size and shape to and are mounted to the second framework 24. Each two adjacent and jointed film units 31 of each film 30*a* have a folding line 32 disposed between the two film units 31. A certain film unit 31 which is connected to the basal frame unit 21 of the first framework 23 has an opening disposed at a center of the film unit 31 for passing through the engaging portions 211 of the basal unit 21 of the first framework 23. When the polygonal rotary projection lamp of the present invention is assembled, one of the film units 31 of each film 30*a* is fixed, the other film units of the film 30*a* can be preliminarily limited to the bottom frame units 22 of the polygonal frame 20 to promote convenience of assembly of the film set 30 and the polygonal frame 20.

With reference to FIGS. 5 to 7, the polygonal fixing frame 40 is detachably connected to the polygonal frame 20 and has multiple top frame units 41. Each top frame unit 41 is connected to one of the bottom frame units 22 corresponding in position to fix a corresponding one of the film units 31. In the embodiment of the present invention, a central portion of each top frame unit 41 is empty. Each top frame unit 41 may be an individual component to reduce remainder resulting from production of the polygonal fixing frame 40. Alternatively, the polygonal fixing frame 40 has two fixing frame sheets 40*a*. A part of the multiple top frame units 41 form one of the two fixing frame sheets 40*a* and correspond in size and shape to and are connected to the first framework 23. The other part of the multiple top frame units 41 form the other one of the two fixing frame sheets 40*a* and correspond in size and shape to and are connected to the second framework 24. The two fixing frame sheets 40*a* are configured to be respectively connected to the first framework 23 and the second framework to promote convenience of assembly of the polygonal fixing frame 40 and the polygonal frame 20.

With reference to FIGS. 2, 3, and 6, the illumination set 50 is mounted within the basal body 11 of the base 10. The illumination set 50 is configured to be electrically connected to a power supply and emit light toward the polygonal frame 20 via the disc 12. The light emitted by the illumination set 50 passes through the film units 30 with the patterns and the patterns are projected.

Moreover, the polygonal rotary projection lamp of the present invention can be electrically connected to an external power supply. Alternatively, with reference to FIG. 4, the base 10 has a battery mount 15 disposed within the basal body 11. The battery mount 15 is electrically connected to the illumination set 50 and the driving motor 13. The battery mount 15 is configured to receive batteries to power the driving motor 13 and the illumination set 50 electrically.

Figure 10:
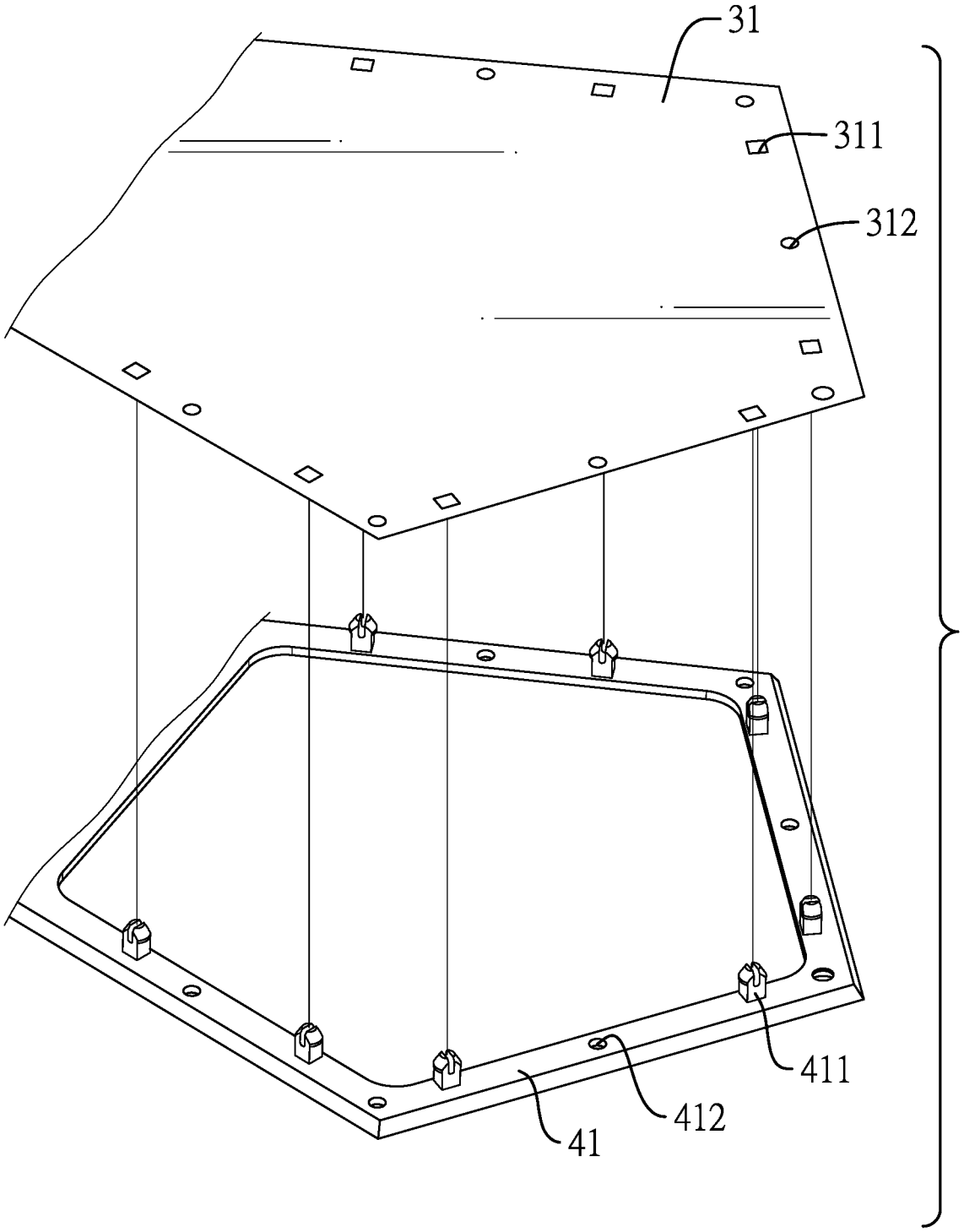
FIG. 10 is a partially exploded perspective view of a top frame unit and a film unit of the polygonal rotary projection lamp in FIG. 1.

In addition, with reference to FIGS. 7, 8, and 10, each of the multiple bottom frame units 22 has at least one assembling portion 221. Each of the multiple top frame units 41 has at least one connecting unit 411. Each of the multiple film units 31 has at least one limiting hole 311. The at least one connecting unit 411 of each of the multiple top frame units 41 respectively passes through the at least one limiting hole 311 of a corresponding one of the multiple film units 31 and is respectively assembled to the at least one assembling portion 221 of a corresponding one of the multiple bottom frame units 22 to fix the corresponding film unit 31. Preferably, each of the at least one assembling portion 221 of each bottom frame unit 22 is a through hole, and each of the at least one connecting unit 411 is a snap rivet.

Besides, with reference to FIGS. 7 and 8, each of the multiple bottom frame units 22 has at least one positioning protrusion 222. Each of the multiple top frame units 41 has at least one positioning recess 412. Each of the multiple film units 31 has at least one positioning hole 312. The at least one positioning protrusion 222 of each of the multiple bottom frame units 22 is respectively mounted through the at least one positioning hole 312 of a corresponding one of the multiple film units 31 and is respectively mounted in the at least one positioning recess 412 of a corresponding one of the multiple top frame units 41.

In the embodiment of the present invention, each of the multiple bottom frame units 22 has multiple assembling portions 221. Each of the multiple film units 31 has multiple limiting holes 311. Each of the multiple top frame units 41 has multiple connecting units 411 respectively connected to the multiple assembling portions 221 of a corresponding one of the multiple bottom frame units 22 to enhance rigidity of the structure of the polygonal rotary projection lamp of the present invention and of the fixation of the multiple film units 31.

With reference to FIG. 8, in a process of producing the polygonal rotary projection lamp of the present invention, the first positioning portions 231 of the first framework 23 of the polygonal frame 20 are respectively inserted into the second aligning units 242 of the second framework 24. Meanwhile, the second positioning portions 241 are respectively inserted into the first aligning units 231 of the first framework 23. The multiple bolts 25 are respectively screwed to the first positioning portions 231 of the first framework 23 and the second aligning units 242 of the second framework 24 to assemble the polygonal frame 20.

Figure 9:
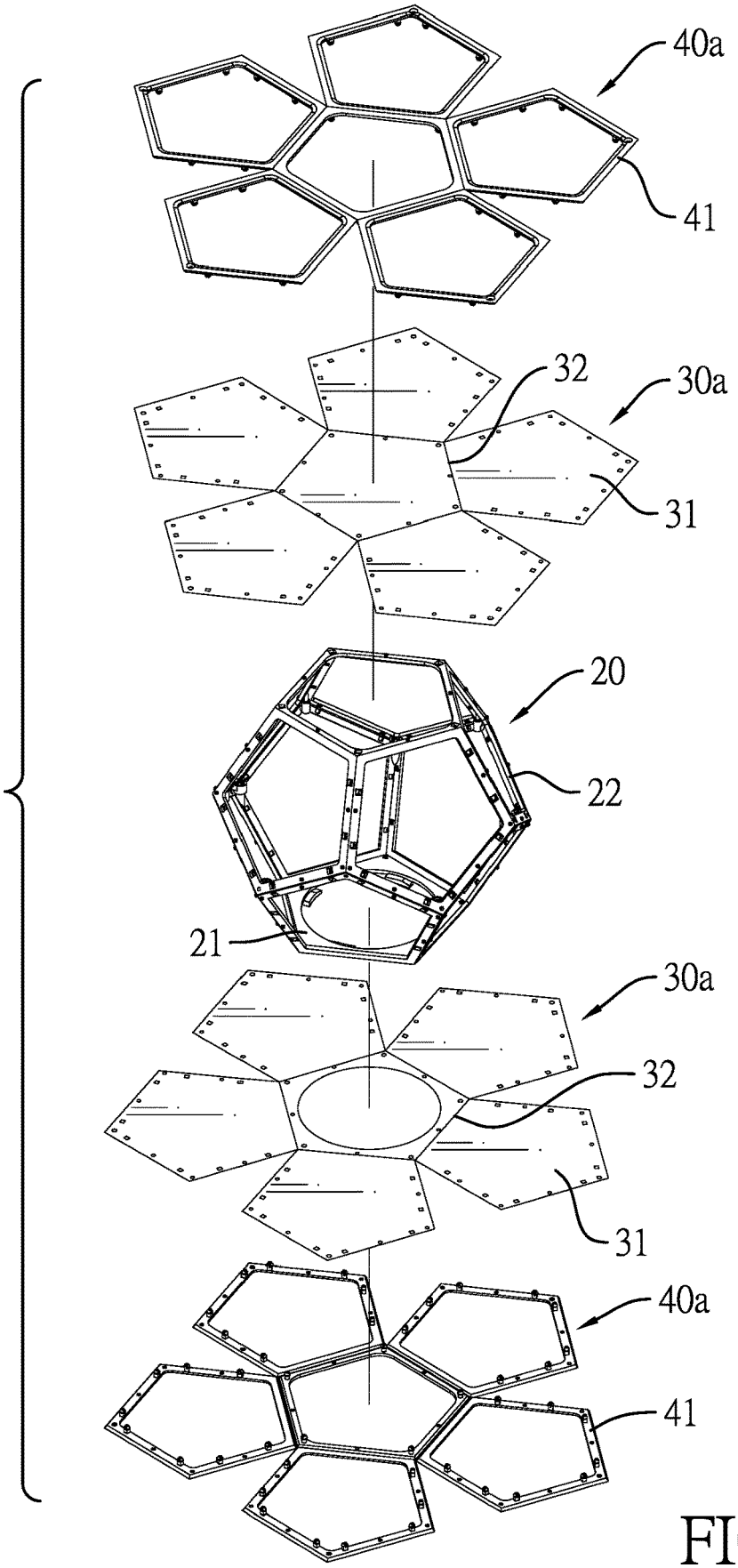
FIG. 9 is an exploded perspective view of the polygonal frame, a film set, and a polygonal fixing frame of the polygonal rotary projection lamp in FIG. 1.

After that, with reference to FIGS. 9 and 10, the film units 31 of each film 30*a* are folded along the folding line 32 between two adjacent film units 31 to let the multiple film units 31 correspond to the bottom frame units 22 of the polygonal frame 20 in positon. The films 30*a* are covered to the polygonal frame 20 to make the multiple film units 31 respectively disposed upon the multiple bottom frame units 22. The multiple top frame units 41 of each fixing frame sheet 40*a* are respectively fitted with the multiple film units 31 of one corresponding film 30*a*. Then, the connecting units 411 of each top frame unit 41 are respectively inserted through the limiting holes 311 of one corresponding film unit 31 of the multiple film units 31 and respectively engaged with the assembling portions 221 of a corresponding one of the multiple bottom frame units 22. The multiple top frame units 41 and the multiple film units 31 are assembled to the polygonal frame 20 accordingly. The engaging portions 211 of the basal frame unit 21 of the first framework 23 respectively engage with the clasps 122 of the disc 12 of the base 10. Assembly of the polygonal rotary projection lamp of the present invention is finished accordingly.

Wherein, when each film 30*a* is covered to the polygonal frame 20, each positioning hole 312 of each film unit 31 is sleeved on one corresponding positioning protrusion 222 of one corresponding bottom frame unit 22 to preliminarily limit the film unit 31 and to prevent the film unit 31 from deflecting while the corresponding bottom frame unit 22 is being assembled to one corresponding top frame unit 41. Ease of assembly of the present invention is promoted accordingly. After each bottom frame unit 22 is assembled to its respective corresponding top frame unit 41, the positioning protrusion 222 of the bottom frame unit 22 is mounted through the positioning hole 312 of a corresponding one film unit 31 and is inserted to the positioning recess 412 of the corresponding top frame unit 41 to promote rigidity of fixation of the corresponding film unit 31.

The illumination set 50 of the polygonal rotary projection lamp of the present invention emits light toward the polygonal frame 20. The light emitted by the illumination set 50 passes through the multiple film units 31, and the pattern of each film unit 31 is projected to the environment accordingly. The driving motor 13, the driving gear set 14, and the ring gear 121 of the disc 12 drive the disc 12 to spin, cause the light emitted by the illumination set 50 to variate, and generate decorative light effect. Moreover, the film set 30 may be detached from the polygonal frame 20 and replaced by another film set 30 with different patterns, thereby promoting decorative effect of the polygonal rotary projection lamp of the present invention.

As stated above, the film set 30 is disposed on the polygonal frame 20, and the connecting units 411 of each top frame unit 40 of the polygonal fixing frame 40 are mounted through the limiting holes 311 of one corresponding film unit 31 and are assembled to the assembling portions 221 of one corresponding bottom frame unit 22 to fix the corresponding film unit 31 on the polygonal frame 20. Then, the polygonal frame 20 is assembled to the base 10 and the polygonal rotary projection lamp of the present invention is manufactured. The film units 31 of each film set 30 are convenient for printing patterns and can effectively shorten time consumption for printing and save production cost. Manufacturing time for producing the polygonal rotary projection lamp of the present invention is reduced.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A polygonal rotary projection lamp comprising:

a base having a basal body; and a disc mounted to the basal body and configured to be driven to spin;

a polygonal frame mounted to the disc of the base, spinning together with the disc, and having a basal frame unit; and multiple bottom frame units connected to one another and mounted to the basal frame unit;

a film set mounted to the polygonal frame and having multiple film units mounted to the polygonal frame and covering the multiple bottom frame units respectively, and each of the multiple film units being flat and having a pattern;

a polygonal fixing frame detachably mounted to the polygonal frame and having multiple top frame units respectively connected to the multiple bottom frame units to respectively fix the multiple film units; and an illumination set mounted within the base and electrically connected to a power supply to emit light toward the polygonal frame, wherein the light passes through each film unit with the pattern to project the pattern.

2. The polygonal rotary projection lamp as claimed in claim 1, wherein the polygonal frame has a first framework having the basal frame unit which is connected to the disc of the base;

a part of the multiple bottom frame units;

multiple first positioning portions; and multiple first aligning units; and a second framework detachably connected to the first framework and having the other part of the multiple bottom frame units;

multiple second positioning portions respectively assembled to the multiple first aligning units of the first framework; and multiple second aligning units respectively assembled to the multiple first positioning portions of the first framework.

3. The polygonal rotary projection lamp as claimed in claim 1, wherein each of the multiple bottom frame units has at least one positioning protrusion;

each of the multiple top frame units has at least one positioning recess; and each of the multiple film units has at least one positioning hole;

the at least one positioning protrusion of each one of the multiple bottom frame units is respectively mounted through the at least one positioning hole of a corresponding one of the multiple film units and is respectively mounted in the at least one positioning recess of a corresponding one of the multiple top frame units.

4. The polygonal rotary projection lamp as claimed in claim 2, wherein each of the multiple bottom frame units has at least one positioning protrusion;

each of the multiple top frame units has at least one positioning recess; and each of the multiple film units has at least one positioning hole;

the at least one positioning protrusion of each one of the multiple bottom frame units is respectively mounted through the at least one positioning hole of a corresponding one of the multiple film units and is respectively mounted in the at least one positioning recess of a corresponding one of the multiple top frame units.

5. The polygonal rotary projection lamp as claimed in claim 2, wherein the film set has two films;

a part of the multiple film units form one of the two films, and correspond in size and shape to and are mounted to the first framework; and the other part of the multiple film units form the other one of the two films, and correspond in size and shape to and are mounted to the second framework.

6. The polygonal rotary projection lamp as claimed in claim 2, wherein the polygonal fixing frame has two fixing frame sheets;

a part of the multiple top frame units form one of the two fixing frame sheets, and correspond in size and shape to and are connected to the first framework;

the other part of the multiple top frame units form the other one of the two fixing frame sheets, and correspond in size and shape to and are connected to the second framework.

7. The polygonal rotary projection lamp as claimed in claim 3, wherein each of the multiple bottom frame units has at least one assembling portion;

each of the multiple top frame units has at least one connecting unit;

each of the multiple film units has at least one limiting hole; and the at least one connecting unit of each one of the multiple top frame units respectively passes through the at least one limiting hole of a corresponding one of the multiple film units and is respectively assembled to the at least one assembling portion of a corresponding one of the multiple bottom frame units.

8. The polygonal rotary projection lamp as claimed in claim 4, wherein each of the multiple bottom frame units has at least one assembling portion;

each of the multiple top frame units has at least one connecting unit;

each of the multiple film units has at least one limiting hole; and the at least one connecting unit of each one of the multiple top frame units respectively passes through the at least one limiting hole of a corresponding one of the multiple film units and is respectively assembled to the at least one assembling portion of a corresponding one of the multiple bottom frame units.

9. The polygonal rotary projection lamp as claimed in claim 1, wherein the disc has a ring gear disposed on a bottom of the disc;

a driving motor and a driving gear set are disposed within the basal body of the base;

the driving gear set is connected to the ring gear and the driving motor;

the driving motor is connected to the power supply and drives the disc to spin via the driving gear set.

10. The polygonal rotary projection lamp as claimed in claim 2, wherein the disc has a ring gear disposed on a bottom of the disc;

a driving motor and a driving gear set are disposed within the basal body of the base;

the driving gear set is connected to the ring gear and the driving motor;

the driving motor is connected to the power supply and drives the disc to spin via the driving gear set.

11. The polygonal rotary projection lamp as claimed in claim 3, wherein the disc has a ring gear disposed on a bottom of the disc;

a driving motor and a driving gear set are disposed within the basal body of the base;

the driving gear set is connected to the ring gear and the driving motor;

the driving motor is connected to the power supply and drives the disc to spin via the driving gear set.

12. The polygonal rotary projection lamp as claimed in claim 4, wherein the disc has a ring gear disposed on a bottom of the disc;

a driving motor and a driving gear set are disposed within the basal body of the base;

the driving gear set is connected to the ring gear and the driving motor;

the driving motor is connected to the power supply and drives the disc to spin via the driving gear set.

13. The polygonal rotary projection lamp as claimed in claim 5, wherein the disc has a ring gear disposed on a bottom of the disc;

a driving motor and a driving gear set are disposed within the basal body of the base;

the driving gear set is connected to the ring gear and the driving motor;

the driving motor is connected to the power supply and drives the disc to spin via the driving gear set.

14. The polygonal rotary projection lamp as claimed in claim 6, wherein the disc has a ring gear disposed on a bottom of the disc;

a driving motor and a driving gear set are disposed within the basal body of the base;

the driving gear set is connected to the ring gear and the driving motor;

the driving motor is connected to the power supply and drives the disc to spin via the driving gear set.

15. The polygonal rotary projection lamp as claimed in claim 9, wherein a battery mount is disposed within the basal body of the base, is electrically connected to the illumination set and the driving motor, and is configured to receive batteries.

16. The polygonal rotary projection lamp as claimed in claim 10, wherein a battery mount is disposed within the basal body of the base, is electrically connected to the illumination set and the driving motor, and is configured to receive batteries.

17. The polygonal rotary projection lamp as claimed in claim 11, wherein a battery mount is disposed within the basal body of the base, is electrically connected to the illumination set and the driving motor, and is configured to receive batteries.

18. The polygonal rotary projection lamp as claimed in claim 12, wherein a battery mount is disposed within the basal body of the base, is electrically connected to the illumination set and the driving motor, and is configured to receive batteries.

19. The polygonal rotary projection lamp as claimed in claim 13, wherein a battery mount is disposed within the basal body of the base, is electrically connected to the illumination set and the driving motor, and is configured to receive batteries.

20. The polygonal rotary projection lamp as claimed in claim 14, wherein a battery mount is disposed within the basal body of the base, is electrically connected to the illumination set and the driving motor, and is configured to receive batteries.

* * * * *